US011291348B2

(12) United States Patent
Woo et al.

(10) Patent No.: US 11,291,348 B2
(45) Date of Patent: Apr. 5, 2022

(54) PUMP AND DISHWASHER COMPRISING THE SAME

(71) Applicant: LG Electronics Inc., Seoul (KR)

(72) Inventors: Sangwoo Woo, Seoul (KR); Youngsoo Kim, Seoul (KR); Hyungman Park, Seoul (KR)

(73) Assignee: LG Electronics Inc., Seoul (KR)

( * ) Notice: Subject to any disclaimer, the term of this patent is extended or adjusted under 35 U.S.C. 154(b) by 404 days.

(21) Appl. No.: 15/928,521

(22) Filed: Mar. 22, 2018

(65) Prior Publication Data

US 2018/0271350 A1 Sep. 27, 2018

(30) Foreign Application Priority Data

Mar. 22, 2017 (KR) ..... 10-2017-0035886
Sep. 1, 2017 (KR) ..... 10-2017-0112095

(51) Int. Cl.
*A47L 15/42* (2006.01)
*A47L 15/00* (2006.01)

(52) U.S. Cl.
CPC ..... *A47L 15/4225* (2013.01); *A47L 15/0015* (2013.01); *A47L 15/4223* (2013.01); *A47L 15/4234* (2013.01); *A47L 15/4285* (2013.01)

(58) Field of Classification Search
CPC ..... A47L 15/4223; A47L 15/4234; A47L 2601/04; A47L 15/4208; F16K 15/04
See application file for complete search history.

(56) References Cited

U.S. PATENT DOCUMENTS 1,943,805 A * 1/1934 Barrie ..... F16K 15/04 137/519.5
5,709,242 A * 1/1998 Bergen ..... F16K 15/04 137/533.11

(Continued)

FOREIGN PATENT DOCUMENTS

DE 102007056707 5/2009
JP 2006-055355 3/2006

(Continued)

OTHER PUBLICATIONS

European Extended Search Report in European Application No. 18163390.0, dated May 30, 2018, 9 pages.

(Continued)

*Primary Examiner* — Joseph L. Perrin
*Assistant Examiner* — Kevin G Lee
(74) *Attorney, Agent, or Firm* — Fish & Richardson P.C.

(57) ABSTRACT

The present disclosure relates to a pump for transmitting washing water and generating steam and a dishwasher including the pump. The pump includes a housing; a washing water inlet pipe coupled to the housing to receive washing water; a washing water outlet pipe coupled to the housing to discharge the washing water; an impeller disposed in the housing to discharge the washing water from the washing water inlet pipe to the washing water outlet pipe; a heater coupled to the housing to heat the washing water in the housing and generate steam; a steam discharge pipe to discharge the steam generated by the heater; and a selector valve coupled to the steam discharge pipe to block the discharge of the washing water and allow the steam to be discharged, thereby preventing the discharge of washing water through the steam discharge pipe.

18 Claims, 10 Drawing Sheets

(56) References Cited

U.S. PATENT DOCUMENTS

| | | | | |
|---|---|---|---|---|
| 9,255,644 | B1 * | 2/2016 | Voigt | F24D 17/0078 |
| 2004/0261824 | A1 * | 12/2004 | Eiermann | A47L 15/4221 134/57 D |
| 2007/0102028 | A1 | 5/2007 | Yoon et al. | |
| 2009/0038694 | A1 * | 2/2009 | Szuster | F16K 15/04 137/533.11 |
| 2011/0247666 | A1 * | 10/2011 | Fiora | A47L 15/0015 134/56 D |
| 2012/0097200 | A1 | 4/2012 | Fountain | |
| 2014/0086770 | A1 | 3/2014 | Octau et al. | |

FOREIGN PATENT DOCUMENTS

| | | |
|---|---|---|
| JP | 2016214386 | 12/2016 |
| KR | 20090060636 | 6/2009 |
| KR | 1020130070275 | 6/2013 |
| KR | 20170010550 | 2/2017 |
| WO | WO2016028049 | 2/2016 |
| WO | WO2017022974 | 2/2017 |

OTHER PUBLICATIONS

International Search Report in International Application No. PCT/KR2018/003349, dated Jul. 30, 2018, 4 pages.
Indian Office Action in Indian Application No. 201917042406, dated Sep. 29, 2020, 7 pages.
Office Action in Korean Appln. No. 10-2017-0112095, dated Aug. 30, 2021, 14 pages (with English translation).

* cited by examiner (a)

PUMP AND DISHWASHER COMPRISING THE SAME

CROSS-REFERENCE TO RELATED APPLICATIONS

This application claims the priority benefit of Korean Patent Application No. 10-2017-0035886, filed on Mar. 22, 2017, and Korean Patent Application No. 10-2017-0112095, filed on Sep. 1, 2017, in the Korean Intellectual Property Office, the disclosures of which are incorporated herein by reference in their entirety.

FIELD

The present disclosure relates to a pump and a dishwasher including the same, and more particularly, to a pump for transmitting washing water and generating steam and a dishwasher including the pump.

BACKGROUND

A dishwasher is a household appliance that removes foreign matter remaining in a tableware by spraying washing water to the tableware. The dishwasher typically includes a tub for providing a washing space, a rack which is provided in the tub and accommodates the tableware, a spraying arm for spraying the washing water into the rack, a sump for storing the washing water, and a pump for supplying washing water stored in the sump to the spraying arm.

Meanwhile, the dishwasher performs cleaning by using heated washing water, or performs cleaning or sterilization of the tableware by supplying steam to the tableware. Conventional dishwashers typically generate hot water or steam by heating washing water stored in the sump through a heater provided inside the sump. In this case, since the heater must be exposed to the inside of the sump and be in contact with the washing water, the water level inside the sump must be controlled so that the heater should not be exposed to prevent overheating of the heater. In addition, since the heat transmission is possible only when the heater is in contact with the washing water, there is a problem that foreign matter adheres to the surface of the heater to deteriorate the heat exchange efficiency and the surface of the heater is corroded to decrease the durability.

To overcome these disadvantages, a dishwasher that installs a heater in a pump has recently been developed. In this case, the heater in the pump heats the washing water to generate hot water or steam. However, there is a problem in that the performance of the pump is deteriorated as the washing water flows out through a flow path through which the steam is discharged.

SUMMARY

The present invention has been made in view of the above problems, and provides a pump and a dishwasher that can generate steam without deteriorating the performance of the pump.

In accordance with the present invention, a dishwasher includes: a housing; a washing water inlet pipe which is coupled to the housing to receive washing water; a washing water outlet pipe which is coupled to the housing to discharge the washing water; an impeller which is disposed in the housing and discharges the washing water flowed into the washing water inlet pipe into the washing water outlet pipe; a heater which is coupled to the housing and heats the washing water in the housing to generate steam; a steam discharge pipe which discharges the steam generated by the heater; and a selector valve which is coupled to the steam discharge pipe to block the discharge of the washing water and allows the steam to be discharged so that the discharge of washing water through the steam discharge pipe can be prevented.

The selector valve is closed when the washing water is introduced, and the selector valve is opened when the steam is introduced.

An inlet of the selector valve is disposed below an outlet of the selector valve.

The selector valve includes: a valve body having a flow path formed therein; a valve seat disposed in an outlet side of the valve body; and a valve ball which is disposed inside the valve body to close the flow path of the valve body in state of contact with the valve seat.

The valve body is formed in a tubular shape and a tube direction is disposed to be inclined upward.

The valve body has a plurality of valve ribs formed inside an inlet side of the valve body to protrude in a radial direction. The valve ball seats on the plurality of valve ribs The plurality of valve ribs are disposed spaced apart in a circumferential direction of the valve body.

A diameter of the valve ball is larger than a separation distance of the plurality of valve ribs and smaller than an inner diameter of the valve body.

A cross-sectional area based on the separation distance of the plurality of valve ribs is smaller than a value which is obtained by subtracting a cross-sectional area of the valve ball from a cross-sectional area of the valve body.

The valve body is formed in a cuboid shape, and the selector valve further includes a tubular outflow unit protruding in a horizontal direction from an upper portion of one side surface of the valve body, and a tubular inflow unit protruding in a horizontal direction from a lower portion of the other side surface of the valve body.

The valve body is formed in a triangular prism shape having an inclined upper surface, and the selector valve further includes a tubular outflow unit protruding in a horizontal direction from an upper portion of one side of the valve body, and a tubular inflow unit protruding in a horizontal direction from a lower portion of the other side of the valve body.

The valve seat has a slit formed in an inner circumferential surface in an inlet side in a longitudinal direction.

The valve ball is formed of alumina.

The selector valve is disposed above the steam discharge pipe.

The dishwasher further includes a motor for rotating the impeller, and the selector valve is disposed above the motor.

In accordance with the present invention, a dishwasher includes: a tub; a spraying arm; a steam nozzle to discharge steam into the tub; a sump to store the washing water; a pump to supply the washing water stored in the sump to the spraying arm and generate steam to supply to the steam nozzle; and a selector valve disposed between the pump and the steam nozzle to block a discharge of the washing water and allow the steam to be discharged.

The selector valve is closed by a washing water flow pressure when the washing water is introduced from the pump.

The selector valve is coupled to the sump.

The dishwasher further includes a supply pipe connecting the sump and the pump, and the selector valve is disposed above the supply pipe.

The selector valve is disposed below the steam nozzle.

BRIEF DESCRIPTION OF THE DRAWINGS

The objects, features and advantages of the present invention will be more apparent from the following detailed description in conjunction with the accompanying drawings, in which.

DETAILED DESCRIPTION

Exemplary embodiments of the present invention are described with reference to the accompanying drawings in detail. The same reference numbers are used throughout the drawings to refer to the same or like parts. Detailed descriptions of well-known functions and structures incorporated herein may be omitted to avoid obscuring the subject matter of the present invention.

Hereinafter, the present invention will be described with reference to the drawings for explaining a pump and a dishwasher including the same according to embodiments of the present invention.

Figure 1:
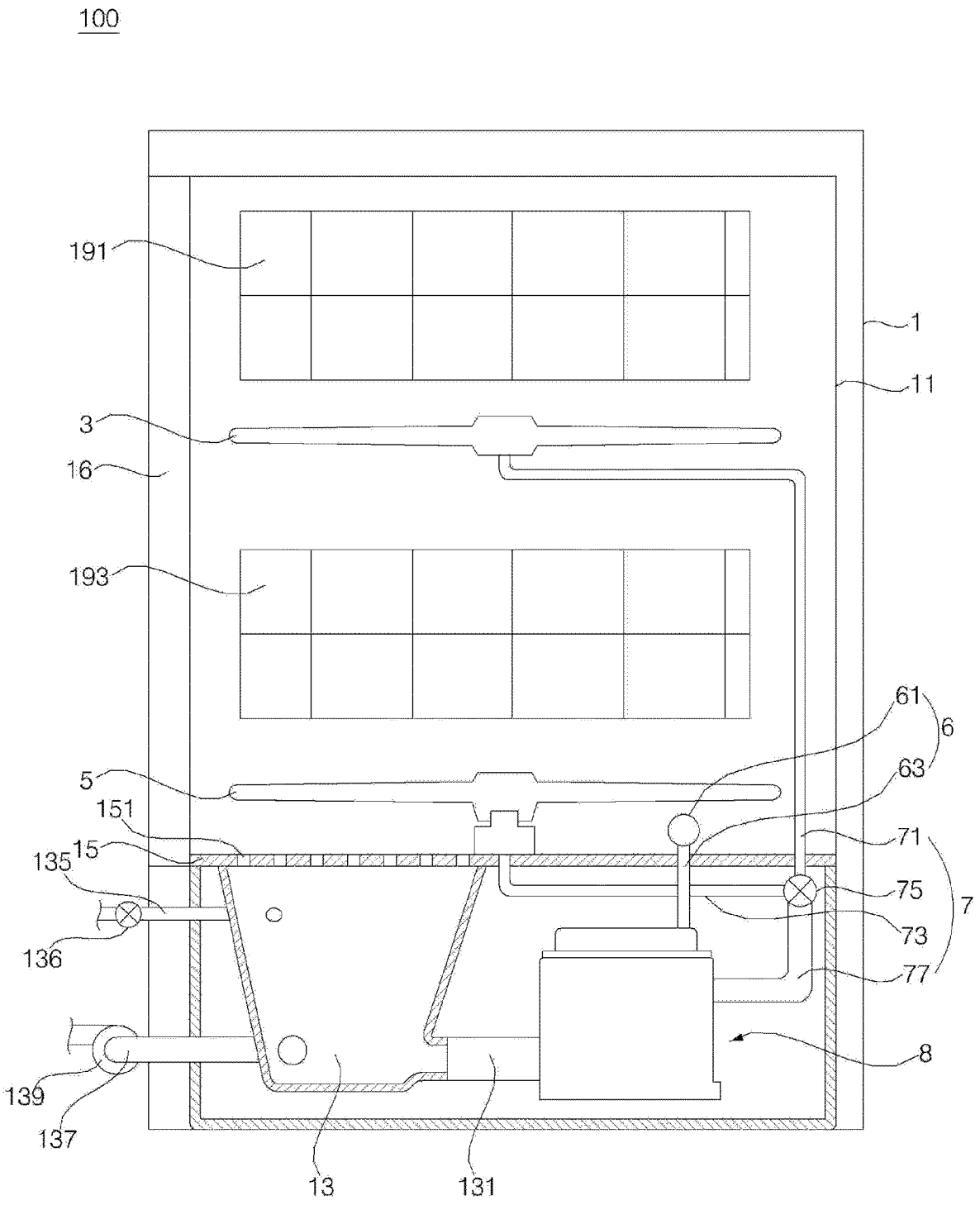
FIG. 1 is a schematic cross-sectional view of a dishwasher according to an embodiment of the present invention.

FIG. 1 is a schematic cross-sectional view of a dishwasher according to an embodiment of the present invention.

A dishwasher 100 according to an embodiment of the present invention may include a cabinet 1 forming an outer appearance, a tub 11 provided inside the cabinet 1 to accommodate a dishware, a plurality of spraying arms 3 and 5 for spraying washing water into the tub 11, a steam supply unit 6 for discharging steam into the tub 11, a sump 13 for storing washing water, and a pump 8 for supplying the washing water stored in the sump 13 to the plurality of spraying arms 3 and 5 and generating steam to supply to the steam supply unit 6.

A plurality of racks 191 and 193 for storing dishware may be provided in the tub 11. The plurality of racks 191 and 193 may include an upper rack 191 provided in an upper area of the tub 11 and a lower rack 193 provided in a lower area of the tub 11.

The tub 11 may be opened and closed by a door 16 provided on one side of the cabinet. A user may take out the plurality of racks 191 and 193 from the tub 11 after opening the door 16.

The plurality of spraying arms 3 and 5 may include an upper arm 3 for spraying washing water to the upper rack 191 and a lower arm 5 for spraying washing water to the lower rack 193. The washing water sprayed from the plurality of spraying arms 3 and 5 may be collected into the sump 13.

The sump 13 may be provided in a lower portion of the tub 11 to store washing water. A sump cover 15 may be disposed in an upper side of the sump 13. The sump cover 15 may be provided with a recovery hole 151 so that washing water in the tub 11 can pass through the recovery hole 151 and flow into the sump 13.

The sump 13 may be coupled to an external water source through a water supply pipe 135. The water supply pipe 135 may be opened and closed by a water supply valve 136. The washing water stored in the sump 13 may be discharged to the outside of the cabinet 1 through a drainage pipe 137 and a drainage pump 139.

The washing water stored in the sump 13 may be supplied to the plurality of spraying arms 3 and 5 through the pump 8 and a washing water supply unit 7. The washing water supply unit 7 may include a main connection pipe 77 coupled to the pump 8, an upper portion connection pipe 71 connecting the main connection pipe 77 and the upper arm 3, and a lower portion connection pipe 73 connecting the main connection pipe 77 and the lower arm 5.

The upper portion connection pipe 71 and the lower portion connection pipe 73 may be branched from the main connection pipe 77, and a switching valve 75 for controlling the opening and closing of the upper portion connection pipe and/or the lower portion connection pipe 73 may be provided in a branch point of the upper portion connection pipe 71 and the lower portion connection pipe 73.

The sump 13 may be coupled to the pump 8 and a supply pipe 131. The supply pipe 131 may guide the washing water in the sump 13 to the pump 8.

The steam supply unit 6 may discharge the steam into the tub 11. The steam discharged from the steam supply unit 6 may rise and act on the tableware housed in the plurality of racks 191 and 193. The steam supply unit 6 may include a steam nozzle 61 disposed in the tub 11 or the door 16 to discharge steam into the tub 11 and a steam supply pipe 63 connecting the steam nozzle 61 and the pump 8.

The pump 8 may transmit the washing water stored in the sump 13 to the washing water supply unit 7. The pump 8 may heat the washing water transmitted to the washing water supply unit 7. The pump 8 may suck the washing water stored in the sump 13 and supply to the plurality of spraying arms 3 and 5 through the washing water supply unit 7.

The pump 8 may generate steam and supply it to the steam supply unit 6. The pump 8 may generate steam by heating the washing water stored in the pump 8 without transmitting the washing water. The steam generated in the pump 8 may be discharged into the tub 11 through the steam supply unit 6.

The pump 8 will be described in detail with reference to FIG. 2 and following drawings.

Figure 2:
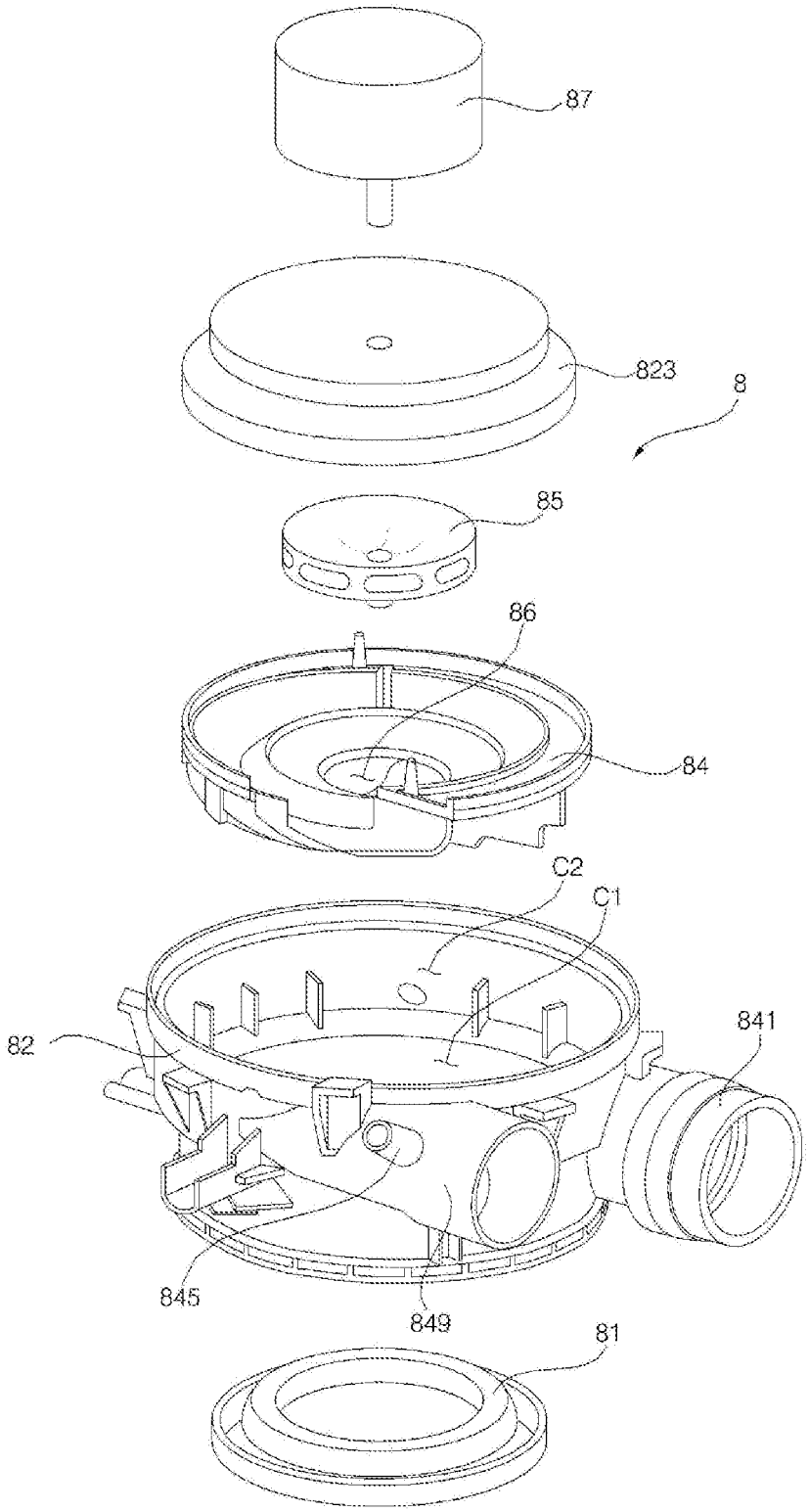
FIG. 2 is an exploded perspective view of a pump according to an embodiment of the present invention.
Figure 3:
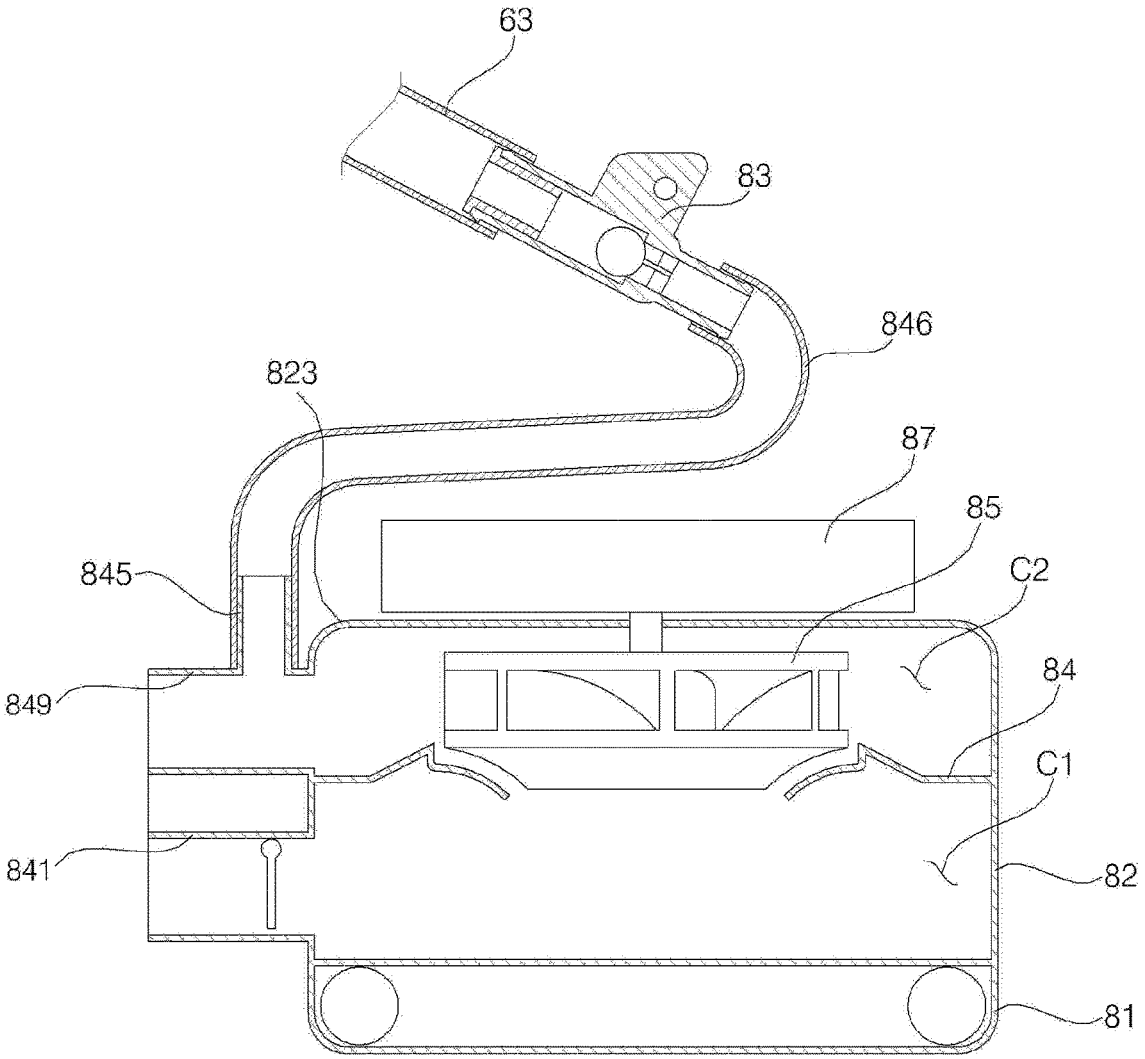
FIG. 3 is a schematic cross-sectional view of a pump according to an embodiment of the present invention.

FIG. 2 is an exploded perspective view of a pump according to an embodiment of the present invention, and FIG. 3 is a schematic cross-sectional view of a pump according to an embodiment of the present invention.

The pump 8 according to an embodiment of the present invention may include a housing 82 having a cylindrical shape which is fixed inside the cabinet 1, a washing water inlet pipe 841 which is coupled to the housing 82 and into which the washing water flows, a washing water outlet pipe 849 which is coupled to the housing 82 and discharges the washing water, an impeller 85 which is disposed inside the housing 82 and discharges the washing water flowed into the washing water inlet pipe 841 to the washing water outlet pipe 849, a heater 81 which is coupled to the housing 82 and heats the washing water inside the housing 82 to generate steam, a steam discharge pipe 845 which is disposed in the washing water outlet pipe 849 and discharges the steam generated by the heater 81, and a selector valve 83 which is coupled to the steam discharge pipe 845 and blocks the discharge of the washing water and allows the discharge of the steam.

The housing 82 may be formed in a cylindrical shape having opened top and bottom. A housing cover 823 may be coupled to the upper end of the housing 82, and the heater may be coupled to the lower end thereof. The housing cover 823 may cover the upper portion of the housing 82, and the housing cover 823 may be provided with a motor 87 for generating a rotational force to rotate the impeller 85.

A partition wall 84 may be disposed inside the housing 82. The partition wall 84 may divide an internal space of the housing 82 into upper and lower portions. The partition wall 84 may form a negative pressure chamber C1 and a positive pressure chamber C2 inside the housing 82. The negative pressure chamber C1 may be a place where a negative pressure is generated by the rotation of the impeller 85 and the positive pressure chamber C2 may be a place where a positive pressure is generated by the rotation of the impeller 85. The negative pressure chamber C1 may be coupled to the sump 13 through the supply pipe 131 and the washing water inlet pipe 841. The positive pressure chamber C2 may be coupled to the plurality of spraying arms 3, 5 through the washing water outlet pipe 849 and the washing water supply unit 7.

The partition wall 84 may be provided with a communication hole 86 for communicating the negative pressure chamber C1 and the positive pressure chamber C2. The surface of the partition wall 84 in the positive pressure chamber C2 side may be formed in a volute.

The impeller 85 may be rotated by the motor 87 to discharge the water in the housing 82 to the outside. The impeller 85 may be rotatably disposed in the positive pressure chamber C2. The impeller 85 may transmit the washing water flowed from the negative pressure chamber C1 into the positive pressure chamber C2 through the communication hole 86 to the washing water outlet pipe 849.

The heater 81 may be coupled to the lower end of the housing 82 to form a bottom surface of the housing 82. The heater 81 may heat the washing water flowing inside the housing 82 when the impeller 85 rotates. The heater 81 may generate steam by heating the washing water in the housing 82 when the impeller 85 stops.

The washing water inlet pipe 841 may be coupled to the negative pressure chamber C1 side of the housing 82. The washing water inlet pipe 841 may be coupled to the supply pipe 131 and the washing water of the sump 13 may flow into the negative pressure chamber C1. The washing water inlet pipe 841 may be disposed to protrude outward from the lower side wall of the housing 82. The washing water inlet pipe 841 may be arranged in such a manner that a pipe direction is horizontal, so that the washing water flows in the horizontal direction. A check valve 842 for opening and closing the washing water inlet pipe 841 may be disposed in the washing water inlet pipe 841.

The washing water outlet pipe 849 may be coupled to the positive pressure chamber C2 side of the housing 82. The washing water outlet pipe 849 may be coupled to the connection pipe 77 of the washing water supply unit 7 so that the washing water of the positive pressure chamber C2 flows out to the connection pipe 77. The washing water outlet pipe 849 may be arranged to protrude outward from the upper side wall of the housing 82. The washing water outlet pipe 849 may be arranged in such a manner that a pipe direction is horizontal, so that the washing water flows in the horizontal direction.

The steam discharge pipe 845 may couple the housing 82 and the steam supply unit 6. The steam discharge pipe 845 may be preferably disposed in the housing 82 or the washing water outlet pipe 849. The steam discharge pipe 845 may supply the steam generated in the housing 82 by the heater 81 to the steam supply unit 6.

The selector valve 83 may be disposed between the steam discharge pipe 845 and the steam supply unit 6. The selector valve 83 may be opened and closed to allow the steam discharged from the steam discharge pipe 845 to flow to the steam supply unit 6 and to prevent the washing water flowed into the steam discharge pipe 845 from flowing out to the steam supply unit 6. When the steam is introduced or when the selector valve 83 is in a normal state (when the washing water is not introduced), the internal flow path of the selector valve 83 may be opened, and the internal flow path may be closed when the washing water is introduced. The inlet of the selector valve 83 may be disposed to be lower than the outlet. At this time, the inlet may be the side to which the steam or the washing water is introduced, and the outlet may be the side to which the steam is discharged. The selector valve 83 may be coupled to the steam discharge pipe 845 and a valve pipe 846. The inlet of the selector valve 83 may be coupled to the valve pipe 846 and the outlet may be coupled to the steam supply pipe 63 of the steam supply unit 6.

The selector valve 83 may be disposed in the upper side of the steam discharge pipe 845. The selector valve 83 may be disposed in the upper side of the motor 87. The selector valve 83 may be disposed in the lower side of the steam nozzle 61. The selector valve 83 may be disposed in the lower side of the tub 11.

Figure 4:
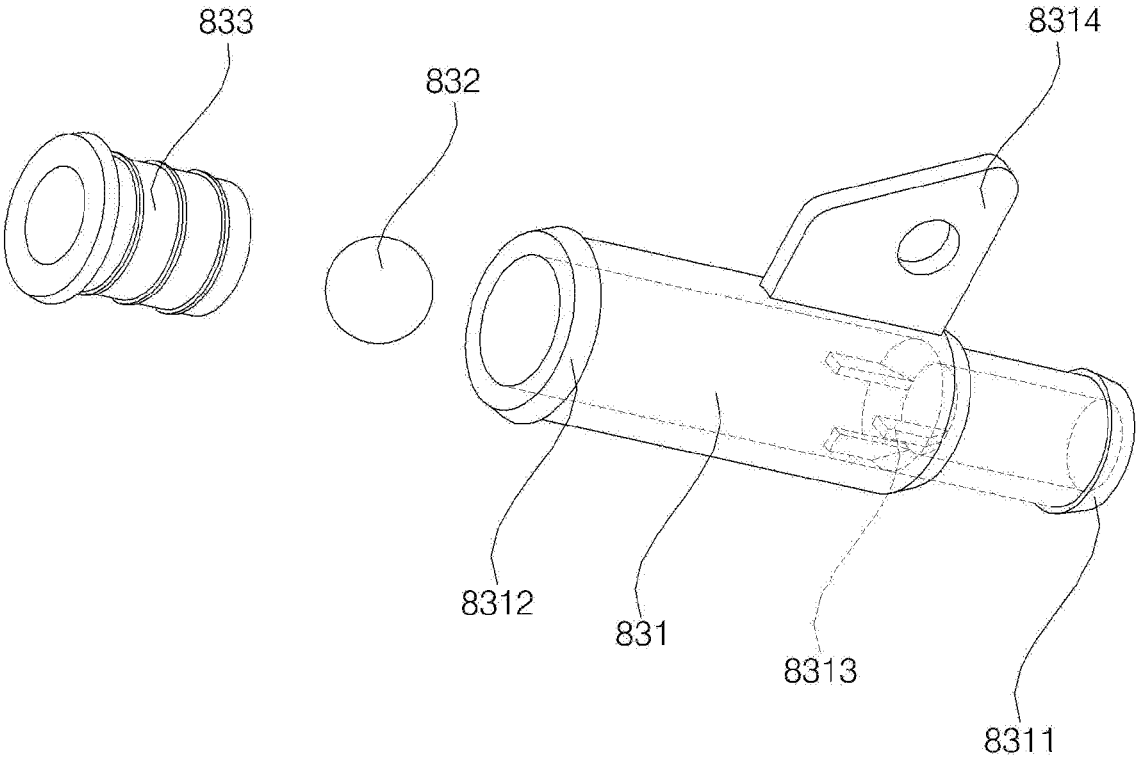
FIG. 4 is an exploded perspective view of a selector valve of a dishwasher according to an embodiment of the present invention.
Figure 5A:
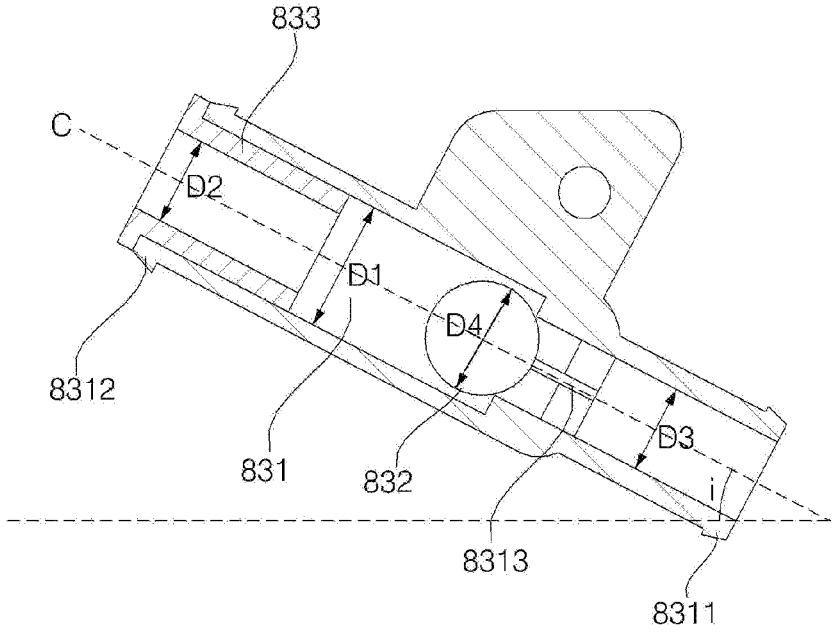
FIGS. 5A and 5B are views illustrating example operations of a selector valve of a dishwasher according to an embodiment of the present invention.
Figure 5B:
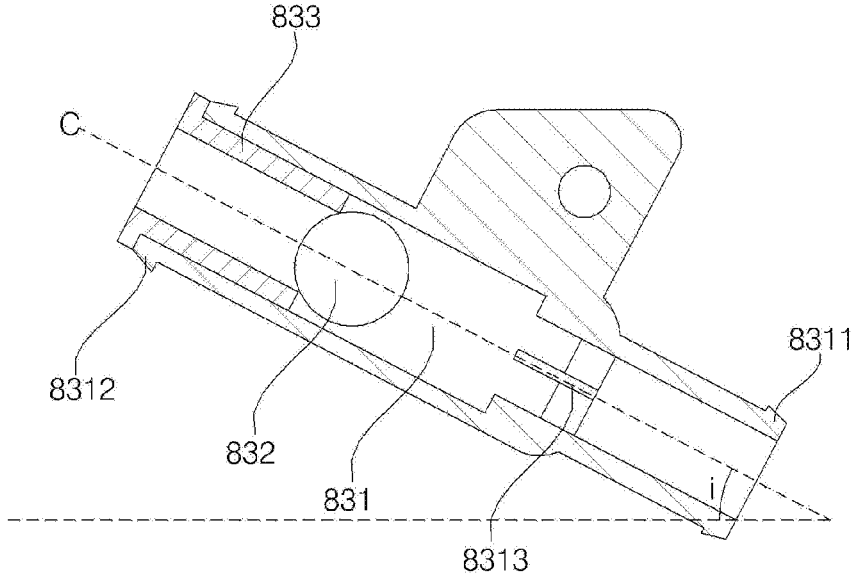
Figure 6:
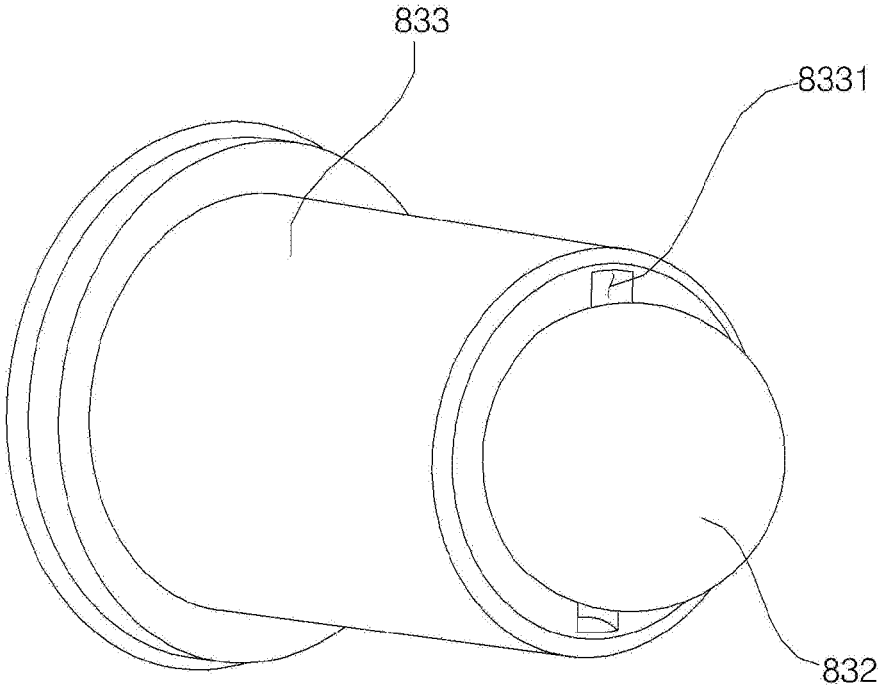
FIG. 6 is a perspective view of a valve seat of a selector valve of a dishwasher according to an embodiment of the present invention.
Figure 7:
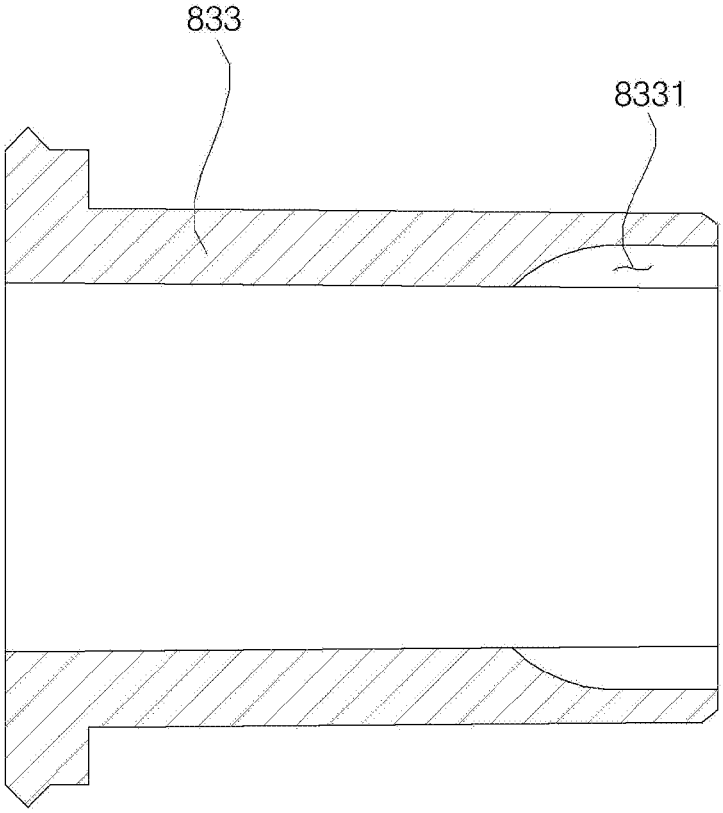
FIG. 7 is a sectional view of a valve seat of a selector valve of a dishwasher according to an embodiment of the present invention.
Figure 8:
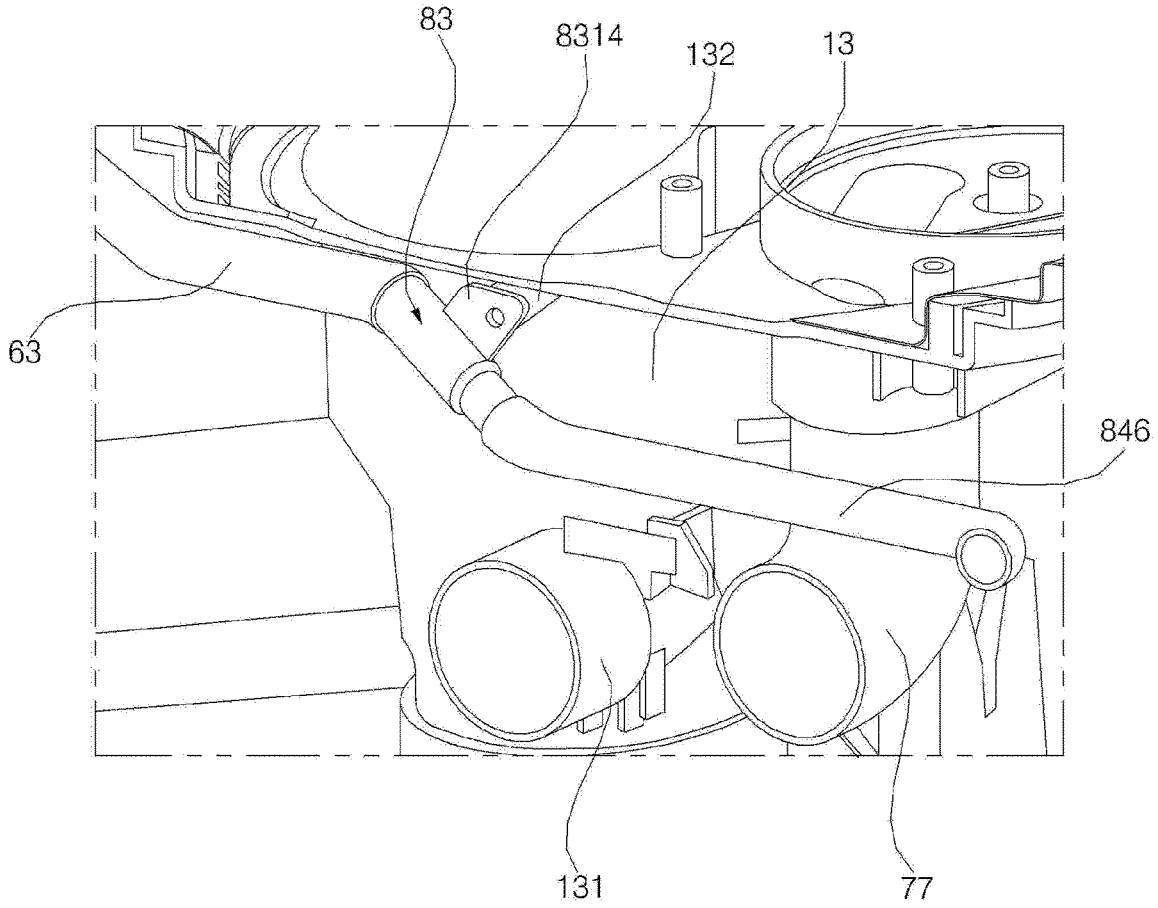
FIG. 8 is a partial perspective view of a dishwasher according to an embodiment of the present invention.

FIG. 4 is an exploded perspective view of a selector valve of a dishwasher according to an embodiment of the present invention, FIGS. 5A and 5B illustrate example operations of a selector valve of a dishwasher according to an embodiment of the present invention, FIG. 6 is a perspective view of a valve seat of a selector valve of a dishwasher according to an embodiment of the present invention, FIG. 7 is a sectional view of a valve seat of a selector valve of a dishwasher according to an embodiment of the present invention, and FIG. 8 is a partial perspective view of a dishwasher according to an embodiment of the present invention.

The selector valve 83 according to an embodiment of the present invention may include a valve body 831 in which a flow path is formed, a valve seat 833 which is disposed in an outlet 8312 side of the valve body 831, and a valve ball 832 which is disposed inside the valve body 831 and in contact with the valve seat 833 to close the flow path of the valve body 831.

In the present embodiment, the valve body 831 may be formed in a tubular shape having a flow path formed therein. Both ends of the valve body 831 may be opened to form an inlet 8311 through which washing water or steam is introduced and the outlet 8312 through which steam is discharged. The valve body 831 may be disposed in such a manner that a tube direction C is inclined upward. That is, the inlet 8311 of the valve body 831 may be disposed lower than the outlet 8312.

The tube direction C of the valve body 831 may have an included angle i which is an acute angle for a horizontal direction. The following experiment is conducted with respect to the included angle i for the tube direction C of the valve body 831.

TABLE 1

| Included angle i | 0 degree | 15 degree | 30 degree | 45 degree |
|---|---|---|---|---|
| Location of valve ball in steaming | Repeat opening and closing due to much movement | Minute movement | Located in lower end | Located in lower end |
| Minimum RPM of motor for closing | 1000 | 1300 | 1500 | 1900 |
| Steam spraying pressure | 0.0040 | 0.0042 | 0.0040 | 0.0041 |
| Steam start time | 05:51 | 04:38 | 05:09 | 05:36 |

As a result of the experiment, when the included angle is 0 degree, that is, when the tube direction C of the valve body 831 is horizontal, the inlet of the valve seat 833 may be closed by the valve ball 832 when steaming, which is not desirable. In addition, when the included angle i is 45 degrees or more, the RPM of the motor 87 should be excessively high in order to close the inlet of the valve seat 833 by the valve ball 832, which causes the wasting of energy. The steam start time, which is the time taken for the steam to be sprayed into the tub 11 after the operation of the heater 81, is shortened at the included angle i ranging from 15 degrees to 30 degrees.

Therefore, it is preferable that included angle i for the tube direction C of the valve body 83115 ranges from 15 degrees to 30 degrees.

The inlet 8311 of the valve body 831 may be coupled to the valve pipe 846 and the outlet 8312 may be coupled to the steam supply pipe 63 of the steam supply unit 6. The valve seat 833 may be inserted and coupled to the outlet 8312 side of the valve body 831. The valve ball 832 may be accommodated in the valve body 831.

A plurality of valve ribs 8313 in which the valve ball 832 is seated may be formed inside the inlet side of the valve body 831. Each of the plurality of valve ribs 8313 may protrude in the radial direction from the inner surface of the valve body 831. The longitudinal direction of each of the plurality of valve ribs 8313 may be disposed in the tube direction of the valve body 831 and the height direction thereof may be disposed in the radial direction of the valve body 831. The plurality of valve ribs 8313 may be disposed spaced apart in the circumferential direction of the valve body 831. At least one upper end of the plurality of valve ribs 8313 may be in contact with the valve ball 832 when washing water does not flow into the interior of the valve body 831.

A valve coupling unit 8314 for coupling the valve body 831 to the sump 13 may be formed in the outer surface of the valve body 831. Referring to FIG. 8, the valve coupling unit 8314 may be coupled to a sump coupling unit 132 formed in the sump 13 by a bolt (not shown). The selector valve 83 may be disposed on the side surface of the sump 13. The selector valve 83 may be disposed in the upper side of the pump 8. It is preferable that the selector valve 83 is disposed in the upper side of the main connection pipe 77. It is preferable that the selector valve 83 is disposed in the upper side of the supply pipe 131.

The valve seat 833 may be formed in a tubular shape and may be inserted into the outlet 8312 of the valve body 831. The valve seat 833 may be formed of a rubber or a plastic of soft material. When the washing water flows into the valve body 831, the lower end of the valve seat 833 may be in close contact with the valve ball 832. When the washing water is introduced, the inlet of the valve seat 833 may be closed by the valve ball 832.

The valve ball 832 may be movably disposed inside the valve body 831. The valve ball 832 may move between the upper end of the plurality of valve ribs 8313 and the inlet of the valve seat 833 inside the valve body 831. The diameter D4 of the valve ball 832 may be smaller than the inner diameter D1 of a portion (the inner diameter of the valve body 831) where the plurality of valve ribs 8313 and the valve seat 833 are not disposed. The diameter D4 of the valve ball 832 may be larger than the inner diameter D2 of the valve seat 833. The diameter D4 of the valve ball 832 may be larger than a separation distance D3 of the plurality of valve ribs 8313. Here, the separation distance D3 of the plurality of valve ribs 8313 may be a diameter D3 of a virtual circle connecting free ends of the plurality of valve ribs 8313.

Since the valve ball 832 is in contact with at least one of the plurality of valve ribs 8313 when steam is generated, the steam should be able to smoothly pass between the plurality of valve ribs 8313. In order to secure the cross-sectional area of the steam flow path, it is preferable that the inner diameter D1 of the valve body 831 is sufficiently larger than the diameter D4 of the valve ball 832. In addition, it is preferable that the cross-sectional area S3 based on the separation distance D3 of the plurality of valve ribs 8313 is smaller than a value which is obtained by subtracting a cross-sectional area S4 based on the diameter D4 of the valve ball 832 from a cross-sectional area S1 based on the inner diameter D1 of the valve body 831. That is, it is preferable that $S3<(S1-S4)$.

Referring to FIG. 5A, when the steam flows into the valve body 831, the valve ball 832 may be in contact with the plurality of valve ribs 8313 or with at least one of the plurality of valve ribs 8313 and the inner surface of the valve body 831 due to its own weight. The steam flowed into the valve body 831 may pass through a space between the plurality of valve ribs 8313 and between the valve ball 832 and the inner surface of the valve body 831 so that the steam is discharged to the steam supply pipe 63 from the valve body 831.

Referring to FIG. 5B, when the washing water flows into the valve body 831, the valve ball 832 may be in close contact with the inlet of the valve seat 833 by the flow pressure or buoyancy of the washing water. When the washing water flows into the valve body 831, the valve ball 832 may close the inlet of the valve seat 833 and close the flow path of the valve body 831. The washing water flowed into the valve body 831 may not be discharged to the steam supply pipe 63 from the valve body 831.

Since the valve ball 832 should be seated in the plurality of valve ribs 8313 by its own weight and should be in close contact with the inlet of the valve seat 833 by the flow pressure and buoyancy of the washing water, it is preferable that the valve ball 832 is made of a metal material having a specific gravity of 1 or more. When the valve ball 832 is in close contact with the inlet of the valve seat 833 as shown in FIG. 5B, the flow pressure of the washing water is not applied as the washing water does not flow. Thus, the valve ball 832 can be released from the valve seat 833. Therefore, it is preferable that the valve ball 832 is made of a relatively light metal so as to be brought into close contact with the inlet of the valve seat 833 by buoyancy. In addition, since the washing water is high temperature and contains detergent and various foreign substances, the valve ball 832 is required to have solidity, heat resistance and chemical resistance. In order to satisfy the above-described conditions, the valve ball 832 is preferably made of alumina.

In order to prevent the valve ball 832 from being separated from the valve seat 833 as the flow pressure of the washing water is not applied when the valve ball 832 is in close contact with the inlet of the valve seat 833 as shown in FIG. 5B, a slit 8331 may be formed in the inner circumferential surface of the valve seat 833 in the inlet side (the side in contact with the valve ball 832) in the longitudinal direction.

Referring to FIGS. 6 and 7, the slit 8331 may prevent the valve ball 832 from completely blocking the inlet side of the valve seat 833. The slit 8331 may be formed in the longitudinal direction in the inner circumferential surface of the valve seat 833. It is not desirable that the slit 8331 is formed from the inlet side to the outlet side of the valve seat 833, and may be formed so as not to exceed half of the length of the valve seat 833 in the inlet side of the valve seat 833. A plurality of slits 8331 may be formed, and two slits 8331 are formed in the present embodiment.

Figure 9:
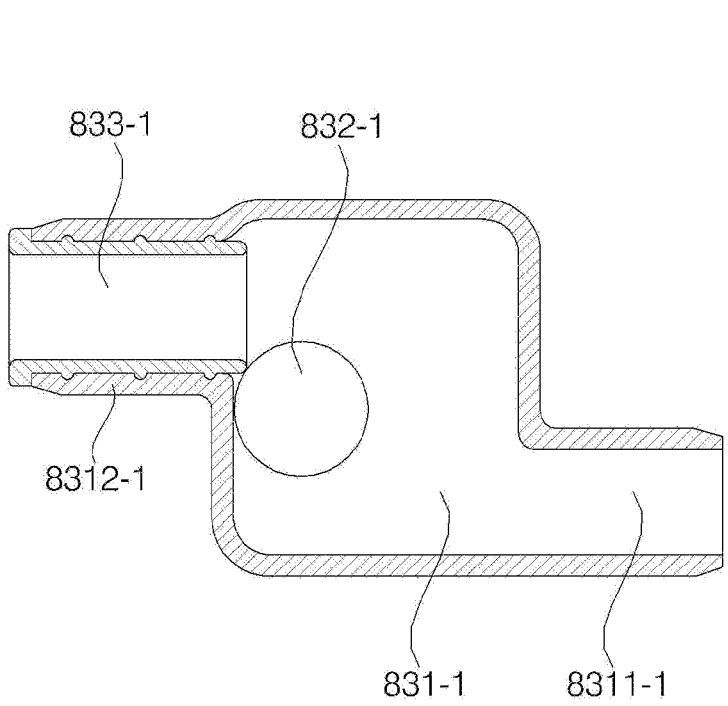
FIG. 9 is a cross-sectional view of a selector valve of a dishwasher according to another embodiment of the present invention.

FIG. 9 is a cross-sectional view of a selector valve of a dishwasher according to another embodiment of the present invention.

The selector valve 83-1 according to another embodiment of the present invention may include a valve body 831-1 formed in a substantially cuboid shape, a tubular outflow unit 8312-1 protruding in the horizontal direction from an upper portion of one side surface of the valve body 831-1, and a tubular inflow unit 8311-1 protruding in the horizontal direction from a lower portion of the other side surface of the valve body 831-1. The inflow unit 8311-1 may receive the washing water or the steam, and the outflow unit 8312-1 may discharge the steam. The valve ball 832-1 according to another embodiment of the present invention may be disposed inside the valve body 831-1. The diameter of the valve ball 832-1 may be larger than the inner diameter of the inlet 8311-1. The valve seat 833-1 according to another embodiment of the present invention may be inserted and coupled to the outflow unit 8312-1.

The valve ball 832-1 may be disposed on the bottom surface of the valve body 831-1 when steam is flowed into the valve body 831-1. When the washing water flows into the valve body 831-1, the valve ball 832-1 may be in close contact with the inlet of the valve seat 833-1 by the flow pressure or buoyancy of the washing water.

Figure 10:
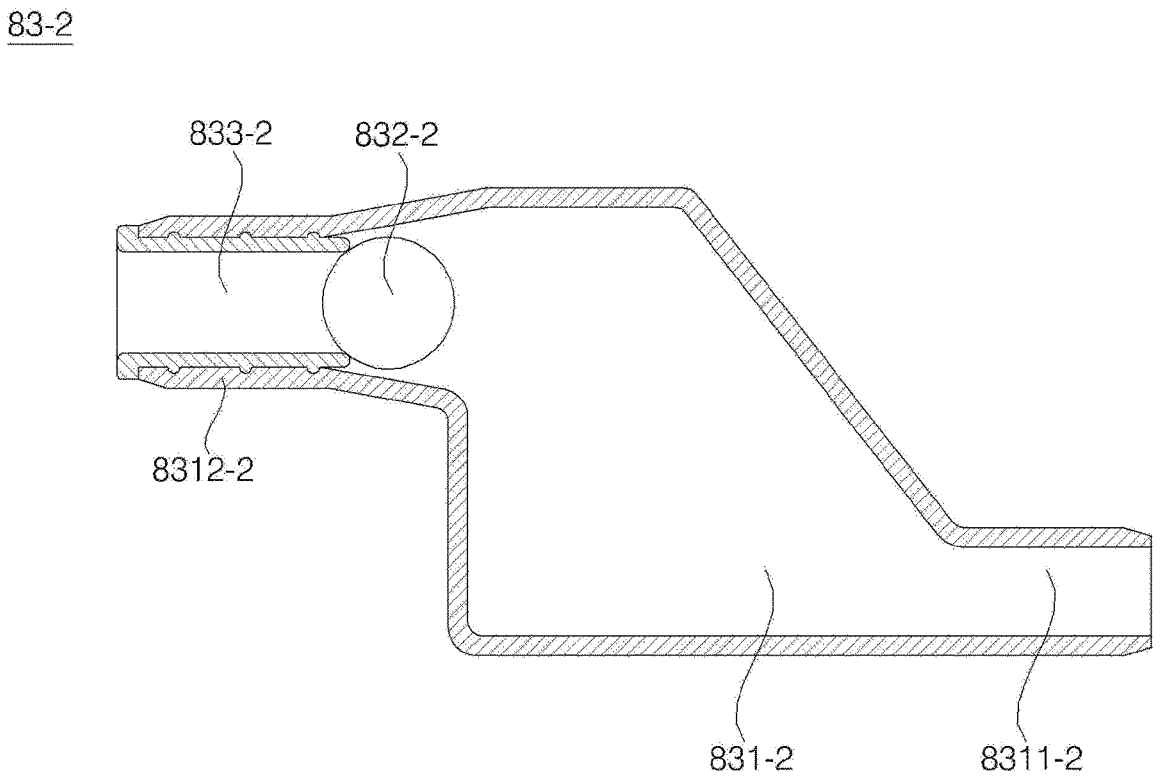
FIG. 10 is a sectional view of a selector valve of a dishwasher according to another embodiment of the present invention.

FIG. 10 is a sectional view of a selector valve of a dishwasher according to another embodiment of the present invention.

The selector valve 83-2 according to another embodiment of the present invention may include a valve body 831-1 formed in a substantially triangular prism shape having an inclined upper surface, a tubular outflow unit 8312-2 protruding in the horizontal direction from an upper portion of one side of the valve body 831-2, and a tubular inflow unit 8311-2 protruding in the horizontal direction from a lower portion of the other side of the valve body 831-2. The valve body 831-2 may be formed in the form of a triangular prism whose front and rear surfaces are substantially triangular. The inflow unit 8311-2 may receive the washing water or the steam, and the outflow unit 8312-2 may discharge the steam. The valve ball 832-2 according to another embodiment of the present invention may be disposed inside the valve body 831-2. The diameter of the valve ball 832-2 may be larger than the inner diameter of the inflow unit 8311-2. The valve seat 833-2 according to another embodiment of the present invention may be inserted and coupled to the outflow unit 8312-2. The outflow unit 8312-2 may be formed to have a diameter that becomes larger toward the side where the inlet side is coupled with the valve body 831-2. At least part of the valve ball 832-2 may be inserted into the inlet side of the outflow unit 8312-2.

When steam is flowed into the interior of the valve body 831-2, the valve ball 832-2 may be disposed on the bottom surface of the valve body 831-2. When the washing water flows into the valve body 831-2, the valve ball 832-2 may be in close contact with the inlet of the valve seat 833-2 by the flow pressure or buoyancy of the washing water.

According to the pump of the present invention and the dishwasher including the same, one or more of the following effects can be obtained.

First, a valve that allows the discharge of steam and prevents the discharge of washing water is applied to a steam discharge pipe, thereby preventing the discharge of washing water through the steam discharge pipe.

Second, the valve is operated by the flow pressure of the washing water, thereby achieving a simple structure and requiring no separate control.

Third, the structure and the arrangement of the valve are optimized so that the steam performance is not deteriorated.

Fourth, the cross-sectional area of the steam flow path inside the valve is secured so that steam can pass smoothly.

Fifth, it is possible to prevent the release of the blocking of the washing water due to the lowering of the washing water flow pressure by the close contact between the valve ball and the valve seat inside the valve.

Hereinabove, although the present invention has been described with reference to exemplary embodiments and the accompanying drawings, the present invention is not limited thereto, but may be variously modified and altered by those skilled in the art to which the present invention pertains without departing from the spirit and scope of the present invention claimed in the following claims.

What is claimed is:

1. A pump comprising:

a housing;

a water inlet pipe coupled to the housing and configured to receive washing water;

a water outlet pipe coupled to the housing and configured to discharge washing water;

an impeller located in the housing and configured to cause washing water to flow from the water inlet pipe to the water outlet pipe;

a heater coupled to the housing and configured to heat washing water in the housing, the heater being configured to generate steam from washing water;

a steam discharge pipe configured to discharge steam generated by the heater; and a selector valve that is coupled to the steam discharge pipe, that is configured to block discharge of washing water through the steam discharge pipe, and that allows discharge of steam through the steam discharge pipe, wherein the selector valve comprises:

a valve body that defines a flow path between an inlet and an outlet of the selector valve, the outlet being located vertically above the inlet, a valve ball located inside of the valve body, a valve seat located at an outlet side of the valve body facing the outlet of the selector valve, and a plurality of valve ribs that are located inside of an inlet side of the valve body, that protrude in a radial direction of the valve body, and that are configured to seat the valve ball, and wherein the valve ball is configured to close the flow path of the valve body based on the valve ball moving to the outlet and contacting the valve seat.

2. The pump of claim 1, wherein the selector valve is further configured to:

close the steam discharge pipe based on introduction of washing water to the selector valve; and open the steam discharge pipe based on introduction of steam to the selector valve.

3. The pump of claim 1, wherein the inlet of the selector valve is connected to the steam discharge pipe, and the outlet of the selector valve is connected to a steam supply pipe of a dishwasher including the pump, the steam discharge pipe being located vertically below the steam supply pipe of the dishwasher.

4. The pump of claim 1, wherein the valve body has a tubular shape and extends in a direction that slopes upward with respect to a bottom of the housing.

5. The pump of claim 1, wherein the plurality of valve ribs are arranged in a circumferential direction of the valve body and spaced apart from each other.

6. The pump of claim 1, wherein the plurality of valve ribs are spaced apart from each other by a separation distance, and wherein a diameter of the valve ball is greater than the separation distance between the plurality of valve ribs and less than an inner diameter of the valve body.

7. The pump of claim 6, wherein an area defined by the separation distance between the plurality of valve ribs is less than a value corresponding to a subtraction of a cross-sectional area of the valve ball from a cross-sectional area of the valve body.

8. The pump of claim 1, wherein the valve seat extends in a longitudinal direction, and defines a slit at an inner circumferential surface of the valve seat, the slit extending from an inlet side of the valve seat in the longitudinal direction.

9. The pump of claim 1, wherein the valve ball comprises alumina.

10. The pump of claim 1, wherein the selector valve is located vertically above the steam discharge pipe.

11. The pump of claim 1, further comprising a motor that is located vertically below the selector valve and that is configured to rotate the impeller.

12. The pump of claim 1, wherein the valve seat is inserted into the outlet side of the valve body.

13. The pump of claim 12, wherein the valve seat comprises a tube that is inserted into the outlet side of the valve body.

14. The pump of claim 12, wherein an outer circumferential surface of the valve seat is in contact with an inner circumferential surface of the valve body.

15. The pump of claim 1, wherein the valve ball is configured to:

based on steam entering into the inlet of the selector valve, separate from the valve seat to thereby allow discharge of the steam through the outlet of the selector valve; and based on washing water entering into the inlet of the selector valve, separate from the plurality of valve ribs and move to the valve seat to thereby block the flow path of the valve body.

16. The pump of claim 15, wherein the valve ball is configured to, based on steam entering into the inlet of the selector valve, contact the plurality of valve ribs to thereby allow discharge of the steam through the outlet of the selector valve.

17. A pump comprising:

a housing;

a water inlet pipe coupled to the housing and configured to receive washing water;

a water outlet pipe coupled to the housing and configured to discharge washing water;

an impeller located in the housing and configured to cause washing water to flow from the water inlet pipe to the water outlet pipe;

a heater coupled to the housing and configured to heat washing water in the housing, the heater being configured to generate steam from washing water;

a steam discharge pipe configured to discharge steam generated by the heater; and a selector valve that is coupled to the steam discharge pipe, that is configured to block discharge of washing water through the steam discharge pipe, and that allows discharge of steam through the steam discharge pipe, wherein the selector valve comprises:

a valve body that defines a flow path between an inlet and an outlet of the selector valve, the outlet being located vertically above the inlet, and a valve ball located inside of the valve body and configured to close the flow path of the valve body based on the valve ball moving to the outlet of the selector valve, wherein the valve body has a cuboid shape that includes a bottom surface, a first side surface, and a second side surface opposite to the first side surface, and wherein the selector valve further comprises:

a tubular outflow unit that protrudes from an upper portion of the first side surface in a horizontal direction with respect to the bottom surface of the valve body, and a tubular inflow unit that protrudes from a lower portion of the second side surface in a direction opposite to the horizontal direction.

18. A pump comprising:

a housing;

a water inlet pipe coupled to the housing and configured to receive washing water;

a water outlet pipe coupled to the housing and configured to discharge washing water;

an impeller located in the housing and configured to cause washing water to flow from the water inlet pipe to the water outlet pipe;

a heater coupled to the housing and configured to heat washing water in the housing, the heater being configured to generate steam from washing water;

a steam discharge pipe configured to discharge steam generated by the heater; and a selector valve that is coupled to the steam discharge pipe, that is configured to block discharge of washing water through the steam discharge pipe, and that allows discharge of steam through the steam discharge pipe, wherein the selector valve comprises:

a valve body that defines a flow path between an inlet and an outlet of the selector valve, the outlet being located vertically above the inlet, and a valve ball located inside of the valve body and configured to close the flow path of the valve body based on the valve ball moving to the outlet of the selector valve, wherein the valve body has a triangular prism shape that includes a bottom surface, an inclined upper surface that slopes with respect to the bottom surface, and a side surface that extends upward from the bottom surface, and wherein the selector valve further comprises:

a tubular outflow unit that protrudes from an upper portion of the side surface of the valve body in a horizontal direction with respect to the bottom surface of the valve body, and a tubular inflow unit that protrudes from a corner region between the bottom surface and the inclined upper surface in a direction opposite to the horizontal direction.

* * * * *